US012292215B2

(12) United States Patent
Strzalka et al.

(10) Patent No.: US 12,292,215 B2
(45) Date of Patent: May 6, 2025

(54) HEAT PUMP ASSEMBLY

(71) Applicant: B/E Aerospace, Inc., Winston Salem, NC (US)

(72) Inventors: Boguslaw Strzalka, Nysa (PL); Dariusz Sapija, Jelcz Laskowice (PL)

(73) Assignee: B/E AEROSPACE, INC., Winston-Salem, NC (US)

( * ) Notice: Subject to any disclaimer, the term of this patent is extended or adjusted under 35 U.S.C. 154(b) by 319 days.

(21) Appl. No.: 17/893,352

(22) Filed: Aug. 23, 2022

(65) Prior Publication Data

US 2023/0056167 A1 Feb. 23, 2023

(30) Foreign Application Priority Data

Aug. 23, 2021 (EP) ..... 21461578

(51) Int. Cl.
*F25B 21/04* (2006.01)

(52) U.S. Cl.
CPC ..... *F25B 21/04* (2013.01)

(58) Field of Classification Search
CPC .... F25B 21/02; F25B 21/04; F25B 2321/023; F25B 2321/025; F25B 2321/0251
See application file for complete search history.

(56) References Cited

U.S. PATENT DOCUMENTS 2,949,014 A * 8/1960 Belton, Jr. ..... F25B 21/02 62/305
7,278,270 B2 * 10/2007 Culp ..... F25B 21/02 136/203
7,918,092 B2 * 4/2011 Lin ..... F25B 21/02 62/3.3
RE44,272 E 6/2013 Bell
8,962,969 B2 * 2/2015 Savelli ..... H10N 19/101 136/200
9,010,129 B2 * 4/2015 Lilke ..... F24H 3/0411 62/3.2

(Continued)

FOREIGN PATENT DOCUMENTS

EP 3159930 A1 4/2017
KR 1020190077646 A 7/2019

(Continued)

OTHER PUBLICATIONS

Machine Translation of Korean Application KR 20190077646 to Kim et al. (Year: 2019).*

(Continued)

*Primary Examiner* — Filip Zec
(74) *Attorney, Agent, or Firm* — CANTOR COLBURN LLP

(57) ABSTRACT

A heat pump assembly includes a plurality of Peltier devices mounted to receive air from a common air inlet, means for causing a current to flow through the Peltier devices, a plurality of first heat sinks arranged in thermal contact with a first, hot, side of the Peltier devices, and a plurality of second heat sinks arranged in thermal contact with a second, cold, side of the Peltier devices. Each of the first heat sinks defines a respective first channel through which inlet air warmed by the hot side of the Peltier devices flows, and each of the second heat sinks defines a respective second channel through which inlet air cooled by the cold side of the Peltier devices flows.

11 Claims, 3 Drawing Sheets

(56) References Cited

U.S. PATENT DOCUMENTS

| | | | | |
|---|---|---|---|---|
| 9,272,647 | B2 | 3/2016 | Gawade et al. | |
| 10,072,881 | B2 * | 9/2018 | Thao | F25B 21/04 |
| 10,305,012 | B2 * | 5/2019 | Toyoda | H10N 10/817 |
| 10,852,076 | B2 * | 12/2020 | Birkett | H10N 10/13 |
| 2008/0229758 | A1 * | 9/2008 | Lin | F28D 15/0275 62/3.2 |
| 2011/0056509 | A1 * | 3/2011 | Benest | A45D 20/10 132/223 |
| 2012/0234021 | A1 * | 9/2012 | Okuda | F28F 9/26 165/165 |
| 2015/0168031 | A1 * | 6/2015 | Oh | B60H 1/2225 62/3.2 |
| 2017/0284709 | A1 * | 10/2017 | Hirsch | H01M 10/486 |
| 2018/0105410 | A1 * | 4/2018 | Kim | F25D 31/006 |
| 2020/0217565 | A1 * | 7/2020 | Boukai | F25B 21/02 |
| 2021/0387557 | A1 * | 12/2021 | Himmelreich | F25D 17/06 |

FOREIGN PATENT DOCUMENTS

| | | | |
|---|---|---|---|
| KR | 102027966 | B1 | 10/2019 |
| WO | 2010135815 | A1 | 12/2010 |

OTHER PUBLICATIONS

Abstract of KR102027966 (B1), Published: Oct. 2, 2019, 1 page.
Abstract of KR20190077646 (A), Published: Jul. 4, 2019, 1 page.
European Search Report for Application No. 21461578.3, mailed Jan. 28, 2022, 7 pages.

* cited by examiner

HEAT PUMP ASSEMBLY

CROSS-REFERENCE TO RELATED APPLICATIONS

This application claims priority to European Patent Application No. 21461578.3 filed Aug. 23, 2021, the entire contents of which is incorporated herein by reference.

TECHNICAL FIELD

The present disclosure relates to a heat pump assembly for heating and cooling using the Peltier effect.

BACKGROUND

There are many applications where heating and cooling is required, e.g. in air conditioning systems in enclosed spaces, in vehicles including under-seat heating/cooling, in computers and electronic devices and systems where circuitry requires cooling etc. A common technique used, particularly in cooling, but also in heating, uses the Peltier effect.

Peltier devices use an array of alternating n- and p-type semiconductors having complementary Peltier coefficients The array of components are soldered together electrically in series and thermally in parallel, between two plates. A voltage is applied across the array and the flow of current through the semiconductors causes a temperature difference across the device. On the side where there is a decrease in temperature (the cold side) heat is absorbed from the environment, thus cooling the environment. The heat that is absorbed is carried through the device by electron transport and is released on the opposite 'hot' side of the device. Peltier devices are reversible and so causing current to flow in the opposite direction results in a heating effect on the environment rather than cooling. Although Peltier devices are most commonly used for cooling they may also be used for heating. Such devices find use in a wide range of applications from air conditions systems, cooling electronic devices or circuitry, providing cooling or warming for domestic appliances, vehicle seats etc. Heat pumps using the Peltier effect have, for example, been put to use in passenger seating cooling/heating systems in aircraft. To ensure the ability to provide both cooling and heating and ensuring passenger comfort, however, relatively large fans are required to draw in air from the environment and also to distribute air from the device. Such fans require a relatively large space and so it has generally only been feasible to use such systems in passenger areas where there is sufficient space e.g. in first or business class seats, but not in the smaller economy seats. For both heating and cooling, it may be necessary to have fans on both sides of the device which, again, also requires a large space for locating the device. Also, in other applications, e.g. for cooling circuitry, known Peltier devices may be too large to be useful.

There is, therefore, a need for a more compact yet effective heat pump that maintains the advantages of the Peltier effect and can be used for both cooling and heating in a wide range of applications and environments.

SUMMARY

According to the disclosure, there is provided a heat pump assembly comprising: a plurality of Peltier devices mounted to receive air from a common air inlet; means for causing a current to flow through the Peltier devices; a plurality of first heat sinks arranged in thermal contact with a first, hot, side of the Peltier devices; a plurality of second heat sinks arranged in thermal contact with a second, cold, side of the Peltier devices; wherein each of the first heat sinks defines a respective first channel through which inlet air warmed by the hot side of the Peltier devices flows; and each of the second heat sinks defines a respective second channel through which inlet air cooled by the cold side of the Peltier devices flows.

The assembly may also comprise a fan arranged to draw air into the common air inlet from the environment.

Harness cables may be provided to secure the Peltier devices in position and via which the current is caused to flow in the Peltier devices.

The components may all be mounted onto a base plate and may be fixed/located with locating pins.

In one example, the assembly comprises four Peltier devices, and wherein the first heat sinks define a cross, each of the four arms defined by a heat sink and extending outwards from the inlet, and each Peltier device is located below and in thermal contact with a respective arm. The second heat sinks may be in the form of L-shaped conduits, each second heat sink located between two adjacent arms of the cross of the first heat sinks. The common air inlet may provided at the centre of the cross shape defined by the first heat sinks.

A passenger seat is also provided having a seat part and a passenger seat air temperature control system located below the seat part.

BRIEF DESCRIPTION

Examples of a heat pump assembly will now be described with reference to the drawings. The drawings and description are by way of example only and variations may also be possible within the scope of the invention as defined by the claims.

DETAILED DESCRIPTION

As mentioned above, heat pump assemblies using Peltier devices are known. These will not be described in detailed but essentially comprise a Peltier device to which a voltage can be applied causing a current to flow through the device. This results in a temperature drop across the device such that one side of the device becomes a 'cold' side and the other is a 'hot' side. An object or fluid or liquid or material to be heated or cooled is located on or in proximity with the Peltier device. For cooling, the cold side of the device absorbs heat from the object/substance/environment adjacent to that side, thus providing a cooling effect on the object/substance/environment. The absorbed heat flows through the Peltier device to the hot side from where it is dispersed. To avoid excessive heat on the hot side, a heat sink or fan may be provided on the hot side to dissipate the heat. For heating, the direction of the current is reversed and the cold side becomes the hot side, and warms the adjacent object/substance/environment and the other side becomes cold. If used as a device for warming and/or cooling air e.g. around a passenger seat of a car, aircraft etc., air from the environment is passed across the Peltier device e.g. by means of a fan and is cooled/warmed as described above.

A problem with such conventional heat pumps as described above is that the warm and cold air cannot be easily separated. Also, as mentioned above, a large, custom-made fan may be needed, thus requiring a sufficiently large space within which to mount the assembly.

The arrangement of the disclosure, described further below, allows for a compact assembly which can be designed to separate warm and cold air and to control the flow of such air to maximise the heating/cooling effect of the assembly.

The assembly has a single one-way air inlet meaning that only a single, and compact fan can be used to direct the inlet air to the assembly.

Figure 1:
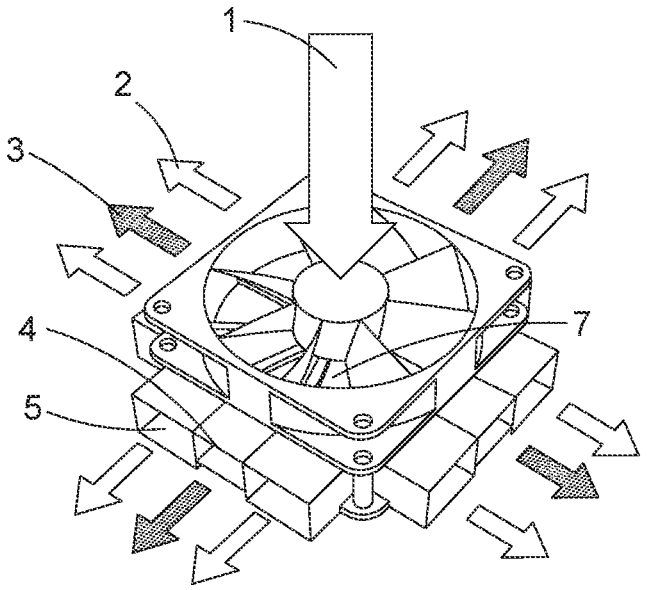
FIG. 1 is a perspective view of a heat pump assembly according to the disclosure.
Figure 2:
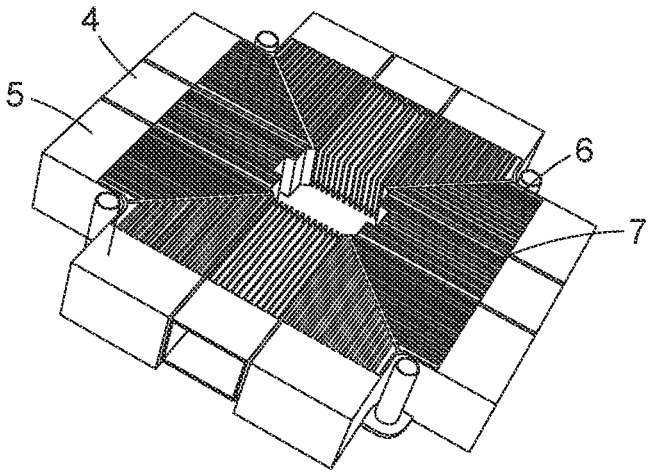
FIG. 2 is a partial view of an assembly such as shown in FIG. 1, with the fan removed for ease of explanation.
Figure 4:
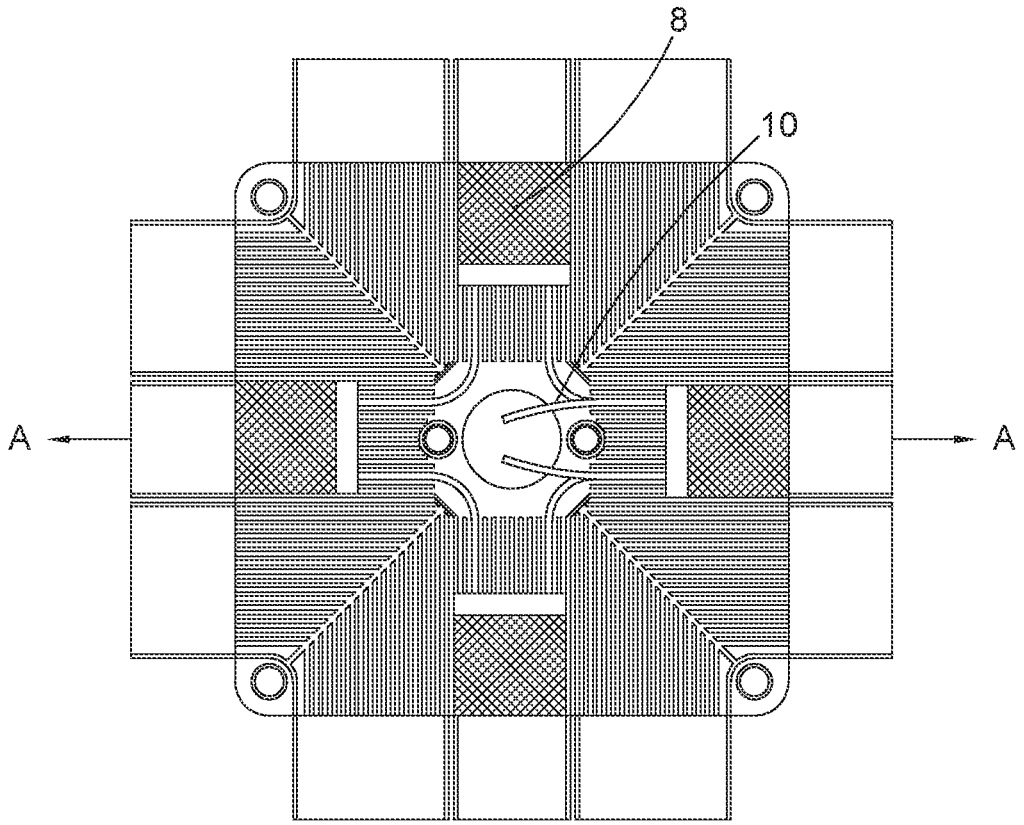
FIG. 4 is a bottom view of an assembly according to the disclosure.
Figure 5:
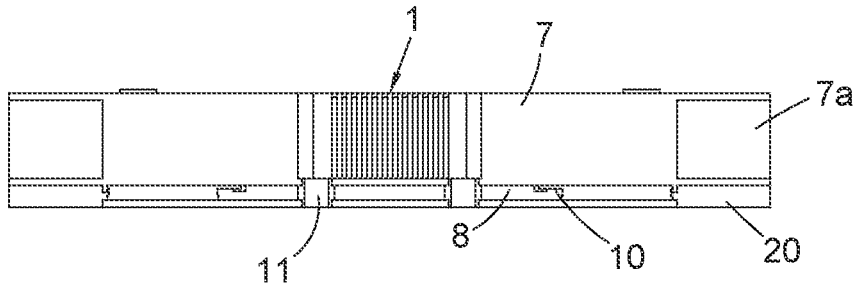
FIG. 5 is a cross-sectional view through section A-A of FIG. 4.

The general principle will first be described with reference to FIGS. 1 and 2. In this example, the assembly has an air inlet 1 and comprises a number of heat sinks 6, 7 defining air outlet channels 5, 4 for cold air 2 and hot air 3 resulting from passage of air from the inlet 1 across a plurality of Peltier devices (not shown in FIGS. 1 and 2, but identified by reference numeral 8 in FIG. 4). The inlet air may be drawn into the inlet 1 by means of a fan 9 mounted on top of the assembly of heat sinks 6, 7.

In the example shown, the assembly comprises a first set of 'cold' heat sinks 6, defining cold air channels 5, and a second set of heat sinks 7 defining hot air channels 4. In this example, the second set of heat sinks 7 define a cross, the four arms of the cross defined by a heat sink 7 and extending outwards from the inlet 1. The first set of heat sinks 6 are essentially L-shaped modules that fit in the corners defined by two adjacent arms of the cross defined by the second set of heat sinks 7 (best seen in FIGS. 2 and 3).

Peltier devices 8 are arranged below, and in thermal contact with the second set of heat sinks. The Peltier devices are provided with harness cables 10 to secure them in place and via which the voltage can be applied to cause the Peltier effect.

Figure 3:
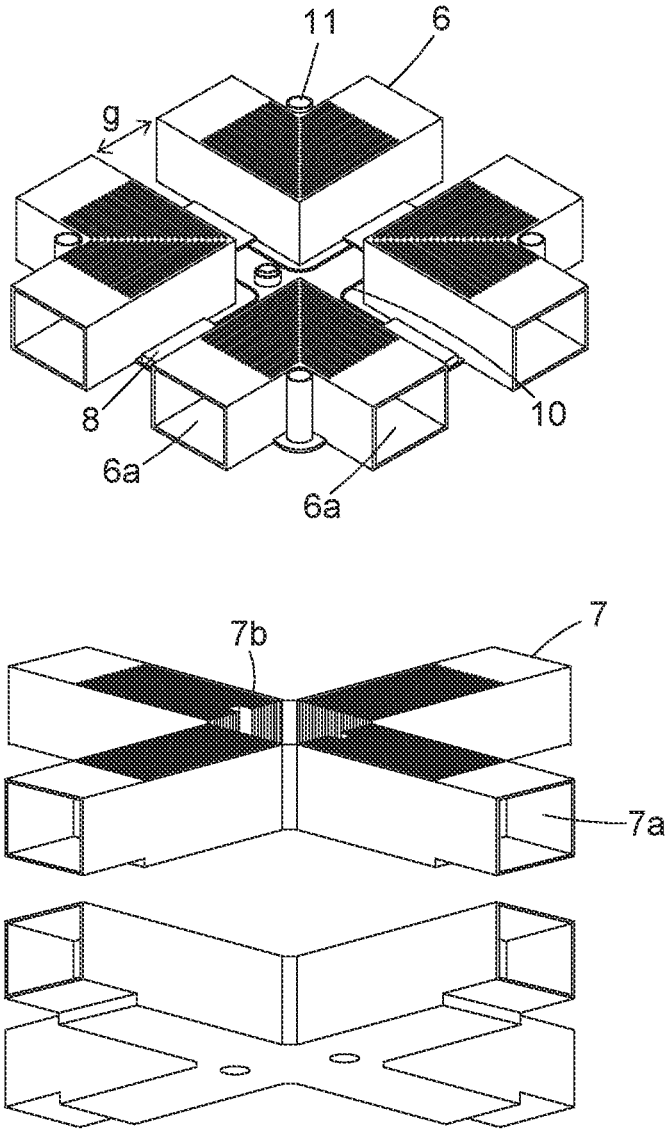
FIG. 3 is an exploded view of the assembly parts shown in FIG. 2.

The way the assembly is assembled can best be seen with reference to FIG. 3, A base plate 20 is provided onto which the first set of heat sinks 6 are formed—here at the four corners of the base plate. The heat sinks 6 are separated by a gap g and a Peltier device 8 is located in each of the gaps on the base plate 20. The Peltier devices are secured together by their harness cables 10. Each of the heat sinks of the first set is in the form of a conduit defining an air channel 5 and providing an outlet 6*a*, 6*b* at each end. Locating and securing pins 11 may be provided on the base plate 20, e.g. at the four corners and/or in the middle.

The location of the first set of heat sinks and the gaps g between them defines a cross-shaped region of the base plate into which the second set of heat sinks 7 is located. These heat sinks are also each in the form of a conduit having an outlet 7*a* and an inlet 7*b*. The second set of heat sinks may be formed as a single module, as shown here, or as separate elements to be mounted into the gaps between the first set of heat sinks. The bottom part of FIG. 3 shows a cut-away view of the second set of heat sinks 7.

Where required, a fan 9 can then be positioned on top of the assembled heat sinks 6, 7 and may be secured by the locating pins 11. The inlet ends 7*b* of the second set of heat sinks 7 meet at a central region of the plate where the air inlet 1 is provided. This may be via the fan 9.

Air then enters the assembly via the inlet 1. For cooling, a suitable voltage is applied to the Peltier devices 8 so that current flows in the 'cooling' direction. In the example shown, then, the side of the Peltier devices 8 onto which the second set of heat sinks 7 is placed is the cold side and the first set of heat sinks (via the plate 20) are in thermal contact with the hot side. The incoming air at the inlet 1 is air to be cooled and is, therefore, initially warm air. This will pass through the second set of heat sinks 7 across the cold side of the Peltier devices and will therefore be cooled and exit the outlets 7*a* as cool air. The air through the conduits of the first set of heat sinks will be warmed by those heat sinks being in contact with the warm side of the Peltier devices.

For warming or heating, the second set of heat sinks are in contact with the hot side of the Peltier devices 8 and the first set of heat sinks are in contact with the cold side and so cooled air exits the first outlets 6*a*, 6*b* and warm air exits the second set outlets 7*a*.

Only one design of assembly has been described above, but other shapes and configurations are also possible within the scope of the claims. Different numbers and relative locations of heat sinks are possible provided they are able to define channels to separate warm and cold air.

The assembly parts can be manufactured using additive manufacturing which allows the shape to be carefully controlled for warm and cold air separation as required. The fan can be a relatively compact, low profile fan to provide the single one-way air inlet.

The invention claimed is:

1. A heat pump assembly comprising:

a plurality of Peltier devices mounted to receive air from a common air inlet;

means for causing a current to flow through the Peltier devices;

a plurality of first heat sinks arranged in thermal contact with a first, hot, side of the Peltier devices; and a plurality of second heat sinks arranged in thermal contact with a second, cold, side of the Peltier devices;

wherein each of the first heat sinks defines a respective first channel through which inlet air warmed by the hot side of the Peltier devices flows; and wherein each of the second heat sinks defines a respective second channel through which inlet air cooled by the cold side of the Peltier devices flows;

wherein the Peltier devices include four Peltier devices, and wherein the first heat sinks define a cross, each of the four arms defined by a heat sink and extending outwards from the inlet, and each Peltier device is located below and in thermal contact with a respective arm;

wherein the second heat sinks are in the form of L-shaped conduits, each second heat sink located between two adjacent arms of the cross of the first heat sinks.

2. The heat pump assembly as claimed in claim 1, further comprising a fan arranged to draw air into the common air inlet from the environment.

3. The heat pump assembly as claimed in claim 1, further comprising harness cables to secure the Peltier devices in position and via which the current is caused to flow in the Peltier devices.

4. The heat pump assembly as claimed in claim 1, comprising a base plate on which the Peltier devices and the first and second heat sinks are mounted.

5. The heat pump assembly as claimed in claim 1, wherein the Peltier devices are located between pairs of first heat sinks and wherein each second heat sink is positioned on top of a respective Peltier device and between respective pairs of first heat sinks.

6. The heat pump assembly as claimed in claim 1, wherein the plurality of first heat sinks are formed as a single first heat sink unit.

7. The heat pump assembly as claimed in claim 1, wherein the plurality of second heat sinks are formed as a single second heat sink unit.

8. The heat pump assembly as claimed in claim 1, wherein the common air inlet is provided at the centre of the cross shape defined by the first heat sinks.

9. The heat pump assembly as claimed in claim 1, further comprising locating pins for securing the heat sinks.

10. A passenger seat air temperature control system comprising:

a heat pump as claimed in claim 1.

11. A passenger seat having a seat part and a passenger seat air temperature control system located as claimed in claim 10 arranged below the seat part.

* * * * *